US007094136B2

(12) United States Patent
Nomoto et al.

(10) Patent No.: US 7,094,136 B2
(45) Date of Patent: Aug. 22, 2006

(54) GRINDING TOOL FOR EDGE CIRCULAR PROCESSING

(75) Inventors: Nobutoshi Nomoto, Ebina (JP); Shin Oshima, Ebina (JP); Naohisa Takahashi, Wyckoff, NJ (US); Gene Presman, Wyckoff, NJ (US)

(73) Assignees: Sankyo Diamond Industrial Co., Ltd., Ebina (JP); Nao Enterprises Inc., Wychoff, NJ (US)

( * ) Notice: Subject to any disclaimer, the term of this patent is extended or adjusted under 35 U.S.C. 154(b) by 0 days.

(21) Appl. No.: 11/148,210

(22) Filed: Jun. 9, 2005

(65) Prior Publication Data

US 2005/0277377 A1 Dec. 15, 2005

(30) Foreign Application Priority Data

Jun. 14, 2004 (JP) ..... 2004-175250

(51) Int. Cl.
*B24B 5/00* (2006.01)
*B23F 21/03* (2006.01)

(52) U.S. Cl. ..... 451/178; 451/450; 451/541; 451/543; 451/545

(58) Field of Classification Search ..... 451/178, 451/231, 450, 542, 541, 543, 545, 913
See application file for complete search history.

(56) References Cited

U.S. PATENT DOCUMENTS 4,611,438 A * 9/1986 Siden ..... 451/541
4,977,709 A * 12/1990 Siden ..... 451/541
5,373,666 A * 12/1994 Quintilio ..... 451/241
5,476,410 A 12/1995 Lupi
5,609,518 A * 3/1997 Lucchesi ..... 451/541
5,727,913 A 3/1998 Naim
6,030,279 A * 2/2000 Russell ..... 451/189
6,358,133 B1 * 3/2002 Cesena et al. ..... 451/450
6,793,564 B1 * 9/2004 Lupi ..... 451/178

FOREIGN PATENT DOCUMENTS

EP 0 649 707 A1 4/1995
EP 0 881 048 A1 12/1998

* cited by examiner

*Primary Examiner*—Eileen P. Morgan
(74) *Attorney, Agent, or Firm*—Oblon, Spivak, McClelland, Maier & Neustadt, P.C.

(57) ABSTRACT

A pair of profile wheels 14, 18 in which concavely shaped grinding surfaces 141, 181 asymmetrical to each other are opposed to each other at right angle so as to form a concavely shaped grinding surface having a substantially semi-circular section, a guide plate 13 which is mounted on a spindle 11 of an electric or air tool side of the profile wheel 14 freely rotatably for guiding a grinding direction by bringing the edge of the circular shaped member into contact with a reference face of a grinding object material and a stopper ring 16 which is mounted to a spindle between the pair of the profile wheels 14 and 18 freely rotatably for controlling a grinding distance Y from the edge by bringing its outer peripheral end face 161 into contact with the edge of the grinding object material, are fixed to the spindle 11 with a lock nut such that they are set at right angle to the spindle.

10 Claims, 7 Drawing Sheets

GRINDING TOOL FOR EDGE CIRCULAR PROCESSING

TECHNICAL FIELD

The present invention relates to a grinding tool for edge circular processing preferably used for so-called full bullnose (shaved head face) processing (hereinafter simply referred to as "full bullnose" or "edge circular processing" depending on the situation), in which the edge of such a plate cutting object material as stone material is ground into a round shape having a substantially semi-circular section and more specifically to a grinding tool for edge circular processing having a guide function capable of grinding with an excellent precision and uniform finish surface when implementing the edge circular processing upon such a plate material as natural stone represented by granite or marble and engineered stone.

BACKGROUND ART

As interior construction material or kitchen top and vanity material in construction site, various kinds of natural stones, engineered stone and the like (hereinafter, referred to simply as "grinding object material" or "stone material" depending on the situation) have been widely used. These stone materials as construction material are marketed as a slab plate 1800 mm–3000 mm on one side and the thickness is usually 20 mm, 30 mm or 40 mm which is presented by laminated in two layers 20 mm pieces and a slab plate composed of stone material used most generally has a thickness of 30 mm.

In recent years, the construction materials represented by these stone materials have been widely used not only for wall surface and floor surface of living space but also as interior materials of bath room and toilet because high grade appearance of its finish surface and excellent heat insulation are preferred. However, because these stone materials are extremely hard and brittle material and the edge corner acts just like a sharp edge blade, these edges which can make direct contact with the human being or the like are chamfered preliminarily to avoid a danger. For example, for the outdoor table and the like, a number of measures have been adopted to implement design esthetic preference as well as safety countermeasure by grinding the edges into a round configuration having a semi-circular section. The processing method for grinding the slab plate edge into a round configuration having semi-circular section is called full bullnose processing in this field, which has been known as one of special processing methods since before.

As a tool for implementing the full bullnose processing on the edge of a slab plate composed of stone material, so-called profile wheel (sometimes called "rounter bit") in which ultra abrasive brazing layer for defining its grinding surface is formed into a configuration corresponding to the processing surface of a grinding object material, has been widely used. As for the profile wheel whose grinding surface is formed into a substantially semi-circular concave configuration, the grinding surfaces opposing each other are formed into a symmetrical configuration including the concave shape so that a pair of the profile wheels are defined by the two pieces or there is a single unit profile wheel in which the grinding surface in the concave shape having the substantially semi-circular section is formed integrally (see, for example, Catalogue of Gran Quartz co.).

Because the medium of the aforementioned stone material is of particular hard/brittle material, originally its processability is extremely bad and thus various devices have been taken since before to grind a grinding object material at a specified accuracy with a diamond tool or CBN tool fixed to the spindle of an electric or air tool rotating at high or low speeds. For example, there have been proposed a rotary grinding tool in which elastic body is interposed between a cutter blade and a spindle so as to absorb vibration or deflection of axis (see, for example Japanese Patent Application laid-open No. 2001-300855) and an offset type grinding tool in which a plurality of ultra abrasive brazing layers are formed on the outer periphery of its substrate and by forming and sintering the ultra abrasive brazing layer while pressurizing at least a portion near the outer periphery of a drawn substrate by means of dies, distortion of the substrate is removed by the sintering to reduce vibration originating from that distortion (see, for example Japanese Patent Application laid-open No. 2002-205274) and these have been actually realized.

It is not easy to fix the profile wheel on the spindle of a rotary electric or air tool such as a polisher in the same way as described above and carry out the so-called full bullnose processing on edges of a plurality of slab plates by manual operation to provide with a round shape having a semi-circular section by securing a specified curvature and a grinding distance Y. It is not sufficient to absorb a vibration or deflection of axis with the above-described method and even a skilled worker can hardly continue the full bullnose processing stably at a good accuracy. Thus, according to a conventional way, generally, slab plates subjected to the full bullnose processing by means of the profile wheels mounted on a special machine have been purchased in a necessary quantity and processed to a predetermined dimension on site and assembled together.

DISCLOSURE OF THE INVENTION

However, it cannot be denied that such interior or exterior construction in this industrial field contains factors which are adjusted on site and it is more difficult than expected to purchase the slab plates whose edges are processed to a predetermined curvature without excess or shortage. Further because there exists a necessity of depending on subscontracted processing by entrusting edge processing specialists with such processing, a large burden is induced in severe price competition and there are instability factors in due date. Although it is possible to purchase a profile wheel specialized machine and carry it to construction site in order to avoid such instability factors, such a specialized machine is too expensive from a small-scale contractor to purchase individually so that he is obliged to bear a large burden if he actually purchases. Thus, although a method of purchasing a marketed profile wheel and attaching it to a hand-held rotary electric or air tool such as a grinder and/or polisher so as to implement the full bullnose processing by manual operation as mentioned above has been tried, it is absolutely difficult to secure a predetermined curvature and grinding distance Y and obtain a uniformly ground face stably and continuously at a good accuracy. Consequently, not only the quality of the finished surface drops but also a further processing is required for its correction thereby leading to a large increase of processing cost.

The slab plates which are the grinding object material which the present invention is applied to are not sold in conditions in which they are processed to 20 mm or 30 mm thick accurately but the thickness varies usually in the unit of 1 mm, in an extreme case, in the unit of several mm. Thus, if the profile wheels of the grinding tool are formed symmetrically to the right and left by setting the radius for forming ¼ concave face of the profile wheel to for example, 16 mm, there arises such a problem that full bullnose processing providing an accurate curved face cannot be obtained because the edges of the grinding object material are crushed at the initial period of grinding and therefore, this has been a problem demanded to be solved quickly.

Accordingly, in views of actual condition of exterior construction with slab plates such as stone materials and taking into account that adjustment on site plays a main role on a final stage, an object of the present invention is to provide a grinding tool capable of implementing the full bullnose processing, stably and continuously, which can be executed immediately as required on site and does not require a special skill level for its operation and always can process the upper ¼ circular section of the edge to the same shape with a simple manual operation of an average skill level worker easily and at a good accuracy even if the thicknesses of the grinding object material differ.

That is, the present invention provides a grinding tool for edge circular processing comrising; a profile wheel in which a semi-conical first profile wheel whose edge has a concavely shaped grinding surface and a semi-conical second profile wheel whose edge has a concavely shaped grinding surface asymmetrical to said first profile wheel are fixed to a spindle of a rotary electric or air tool such that the grinding surfaces are opposed to each other at right angle so as to form a substantially semi-circular concavely shaped grinding surface while that grinding surface acts as an outer peripheral face, a guide plate which is a disk-like member mounted on the spindle between the profile wheel and the rotary electric or air tool freely rotatably and for guiding a grinding direction by bringing the edge of the disk-like member into a contact with the reference face of a grinding object material surface; and a stopper ring which is a ring-like member mounted on the spindle between the first profile wheel and the second profile wheel freely rotatably and for controlling a grinding distance Y from the edge by bringing an outer peripheral end face thereof into a contact with the edge of the grinding object material, wherein the profile wheel, the guide plate and the stopper ring are fixed to the spindle of the rotary electric or air tool at right angle thereto with a lock nut.

Further, the present invention provides the grinding tool for edge circular processing wherein the guide plate is a disk-like member having a bearing fitting hole in the center thereof and having a diameter larger than the maximum outside diameter of the profile wheel and the mounting of the rotary electric tool on the spindle is carried out through the first bearing to be fitted to the bearing fitting hole. Still further, the present invention provides the grinding tool for edge circular processing wherein the stopper ring is a ring-like member having a bearing fitting hole in the center thereof and having an outside diameter substantially equal to or slightly larger than the minimum diameter of the grinding surface of the pair of the profile wheels and the mounting of the rotary electric or air tool on the spindle is carried out through the second bearing to be fitted to the bearing fitting hole.

Further, the present invention provides the grinding tool for edge circular processing wherein the first profile wheel is mounted on an electric or air tool side such that the grinding surface is directed forward with the guide plate located behind the first profile wheel and the second profile wheel is mounted such that the grinding surface is directed rearward with a lock nut located behind the second profile wheel.

Further, the present invention provides the grinding tool for edge circular processing wherein the grinding surface of the second profile wheel is provided with a substantially tapered inclined face which is extended to the outer periphery from a substantially middle portion of a R-shaped curved face.

Further, the present invention provides the grinding tool for edge circular processing wherein a plurality of cutout portions are formed in the grinding surface of the profile wheel at an equal pitch along the circumference such that the cutout portions are extended in the axial direction.

Further, the present invention provides the grinding tool for edge circular processing wherein an arbitrary number of through holes for supplying grinding water to the grinding surface, at least one through hole is provided toward the axis direction in the cutout portion formed in the grinding surface of the profile wheel.

Further, the present invention provides the grinding tool for edge circular processing wherein the guide plate and stopper ring are manufactured of metal, resin or composite material thereof.

Further, the present invention provides the grinding tool for edge circular processing wherein the grinding object material is a square plate composed of natural stone, engineered stone or the like.

Further, the present invention provides the grinding tool for edge circular processing wherein the edge of the grinding object material after edge circular processing with said grinding tool is formed into round shape having a substantially semi-circular section while the upper ¼ circular portion of the semi-circular section shape is always ground into the same shape regardless of the thickness of the grinding object material.

Use of the grinding tool for edge circular processing enables the so-called full bullnose processing to be carried out stably and continuously at a high precision, the full bullnose processing grinding over a predetermined distance Y inward from the edge of the slab plate such as stone material with the concavely shaped grinding surface of the profile wheel always maintained at a constant angle. Because the first profile wheel and the second profile wheel opposing each other in pair are formed asymmetrically in terms of their grinding surfaces and particularly the grinding surface of the second profile wheel mounted on the nut side is provided with a substantially tapered inclined surface directed to the outer periphery, extended from substantially the middle portion of the R-shaped curved face, the object material can be ground smoothly without breaking the edge thereof at the initial period of grinding and even if there exists more or less disparity in the thickness of the slab plate, this can be accepted and met flexibly. Further, because the upper half portion of curved surface formed on the edge of the object material, that is, the curved surface constituting the upper ¼ circular section, is always ground to the same shape even if the object material has a different thickness, when ground materials after the edge circular processing are arranged in line, in observation from obliquely above which is an natural viewpoint of a looker, a neat and uniform finish surface is provided.

Upon edge circular processing to the edge of a grinding object material with this grinding tool for edge circular processing grinding tool, with the edge on the profile wheel side of the guide plate in contact with the surface of the grinding object material, that is, the reference surface at the time of grinding startup or on grinding process, the profile wheel is guided so as to maintain horizontality to the reference surface of the grinding object material. Thus, even a worker having a relatively short experience can handle an electric or air tool rotating at high or low speeds, so that the grinding work for forming a predetermined curvature on an edge can be continued with the safety.

Even when materials ground in this manner are joined in line in plural quantity, an accurate curved face is maintained in the edge and the entire length of the slab plates is maintained constant. In this way, the edge circular processing on the slab plates can be implemented on site by manual operation of a standard worker easily, accurately and effectively. Therefore, an excessive investment for purchasing an expensive special machine is unnecessary, and increase of cost due to excessive purchase of construction materials and delay of construction due to shortage of materials are eliminated preliminarily. Further, it is possible to make free of burden of dependence on a special subcontractor and accurate construction by adjustment on site can be implemented effectively with less material and at low cost. Further, the profile wheel of the present invention is capable of grinding slab plates having different thicknesses to a uniform finish surface having a desired curvature without damaging the grinding surface and thus it is expected that this grinding tool is applied to a wide industrial field.

DETAILED DESCRIPTION

Figure 1:
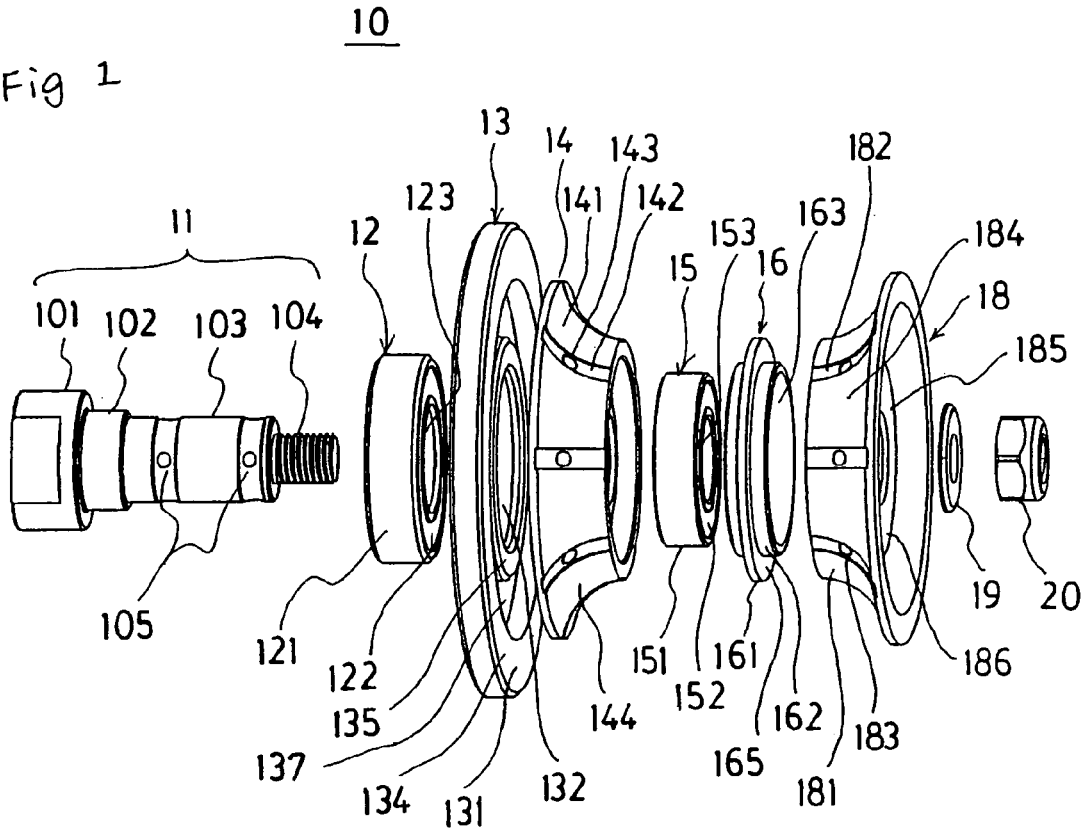
FIG. 1 is a disassembly perspective view of the grinding tool for edge circular processing of this embodiment as seen from its front end (opposite side to an electric tool)
Figure 2:
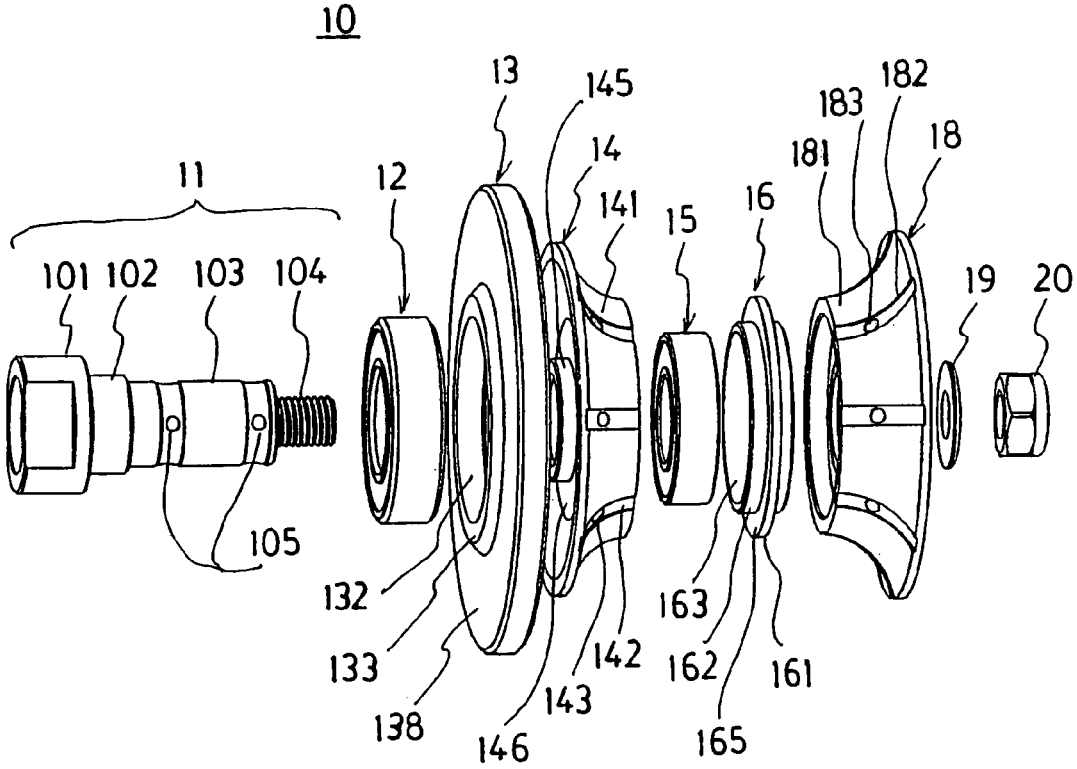
FIG. 2 is a disassembly perspective view of the grinding tool for edge circular processing of this embodiment as seen from the side of an electric tool.

Next, the grinding tool for edge circular processing of an embodiment of this invention will be described with reference to FIGS. 1–9. In the meantime, description of the rotary electric or air tool is omitted in the Figures. In this specification, the "forward" refers to the nut side and "rearward" refers to the electric tool side.

The grinding tool for edge circular processing of the present invention is used preferably for implementing the processing of a substantially semi-circular section having a predetermined curvature, that is, the full bullnose processing on the edge of a slab plate composed of natural stone materials such as granite and marble, artificial stone such as engineered stone and the like. In the grinding tool for edge circular processing of the present invention, a spindle 11 of a rotary electric tool is a spindle having a stepped configuration in this example, which is comprised of a proximal portion 101, a first spindle main body 102 having a smaller diameter than the proximal portion 101, a second spindle main body 103 having a smaller diameter than the first spindle main body 102 and a male screw portion 104 having a smaller diameter than the second spindle main body 103, these components being integrated. The proximal portion 101 transmits a rotation of the electric tool to the spindle main body and fastens various kinds of components sandwiched between the proximal portion 101 and the lock nut 20 to the spindle 11 with a tightening force of the lock nut 20. In the outer peripheral face of the second spindle main body 103 are provided openings 105 which communicate with the inside of the spindle 11 at an appropriate pitch. In the case of wet grinding, the openings 105 serve as water ports for water for grinding which is supplied from the front end of the spindle of the electric or air tool through the interior of the spindle to grinding faces 141, 181 of profile wheels 14, 18 and are arbitrary components. Although as the spindle 11 of the rotary electric or air tool of this embodiment, the one having the multiple steps is adopted, the present invention is not restricted to this example, but it is redesigned appropriately corresponding to the fitting hole in each component to be fitted to the spindle 11 or the inside diameter of a used bearing. For example, it is permissible to use a single shaft type having no step. As the rotary electric or air tool, a hand-held rotary electric or air tool such as a disk grinder, sander and polisher can be mentioned.

In the profile wheel, as shown in FIGS. 1–6, a substantially semi-conical first profile wheel 14 having a grinding surface 141 whose side view is of concave shape and a substantially semi-conical second profile wheel 18 having a grinding surface 181 asymmetrical to the first profile wheel 14, whose side view is of concave shape are fixed to the spindle 11 of a rotary electric tool such that their grinding surfaces 141, 181 are opposed to each other so as to form a concavely shaped grinding face R having a substantially semi-circular section while the grinding face R serves as an external peripheral face. Both the first profile wheel 14 and second profile wheel 18 have a substantially semi-conical appearance and are comprised of a fitting hole in the center thereof, which the second spindle main body 103 is fitted to, thick portions 145, 185 around those fitting holes and main body portions 146, 186 which are extended from thin portions outside the thick portions 145, 185 so that the thickness increases gradually finally reaching the grinding faces 141, 181. The first profile wheel 14 is mounted onto the spindle 103 on the side of a guide plate 13 such that the grinding surface 141 is directed forward and the second profile wheel 18 is mounted onto the spindle 103 on the nut side such that the grinding face 181 is directed rearward.

Figure 6:
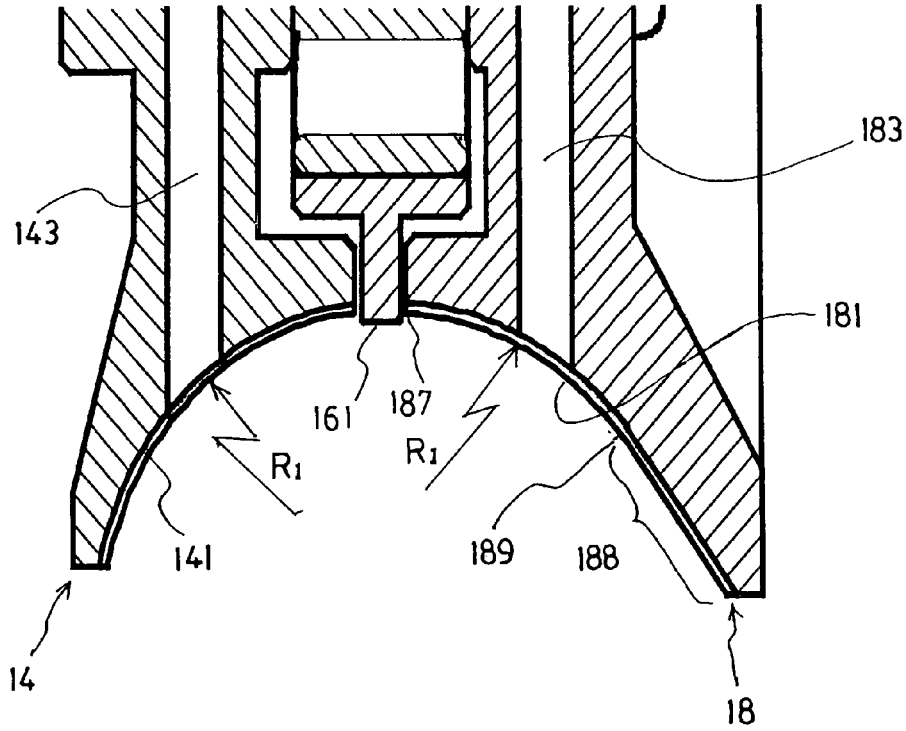
FIG. 6 is an enlarged diagram for explaining the configuration of a grinding face.

The grinding surface 141 of the first profile wheel 14 and the grinding surface 181 of the second profile wheel 18 are designed so that curvatures which specify the concave shapes of the grinding surfaces 141, 181 are different from each other. More specifically, as shown in FIG. 6, while the grinding surface 141 of the first profile wheel 14 is formed in a concave shape which entirely draws a semi-circular section having a radius $R_1$, the grinding surface 181 of the second profile wheel 18 is so constructed that an inside portion with respect to a substantially middle portion 189 of that concave shape is formed in a concave shape which draws a semi-circular section having a radius $R_1$ while an outside portion with respect to the substantially middle portion 189 has an inclined face 188, which is substantially tapered in the circumferential direction. The inclination angle of the tapered inclined face 188 is not restricted to any special one but an extent that the front end thereof is opened slightly outward from the substantially middle portion 189 as compared with a circle is preferable in that the grinding surface is formed smoothly. Because in the profile wheels 14, 18 in pair of the present invention, the grinding surface 181 of the second profile wheel 18 on the lock nut side is opened outwardly, it never crushes the edge of a grinding object material at the initial period of grinding to achieve smooth grinding and even if there is more or less disparity in the thickness of the slab plate which is a grinding object material, it can accept it to correspond flexibly.

On the grinding surfaces 141, 181 of the profile wheels 14, 18 are formed abrasive brazing portions 144, 184 composed of mainly diamond abrasive brazing and CBN abrasive brazing and preferably, a plurality of cutout portions (cutout grooves) 142, 182 are extended along the axial direction at an equal pitch toward the circumference as desired and further, at least one through hole 143, 183 is provided in the cutout portion (cutout grooves) 142, 182. Consequently, discharge of cutting particles and cooling of the abrasive brazing portions 144, 184 can be achieved effectively so that biting of a blade into the grinding object material is kept excellent, thereby not only providing a sharp cutting performance but also improving the service life as a grinding tool. In the meantime, the through holes 143, 183 communicate with the opening 105 in the spindle 11 through a communication hole in the profile wheel main body portions 146, 186.

Figure 5:
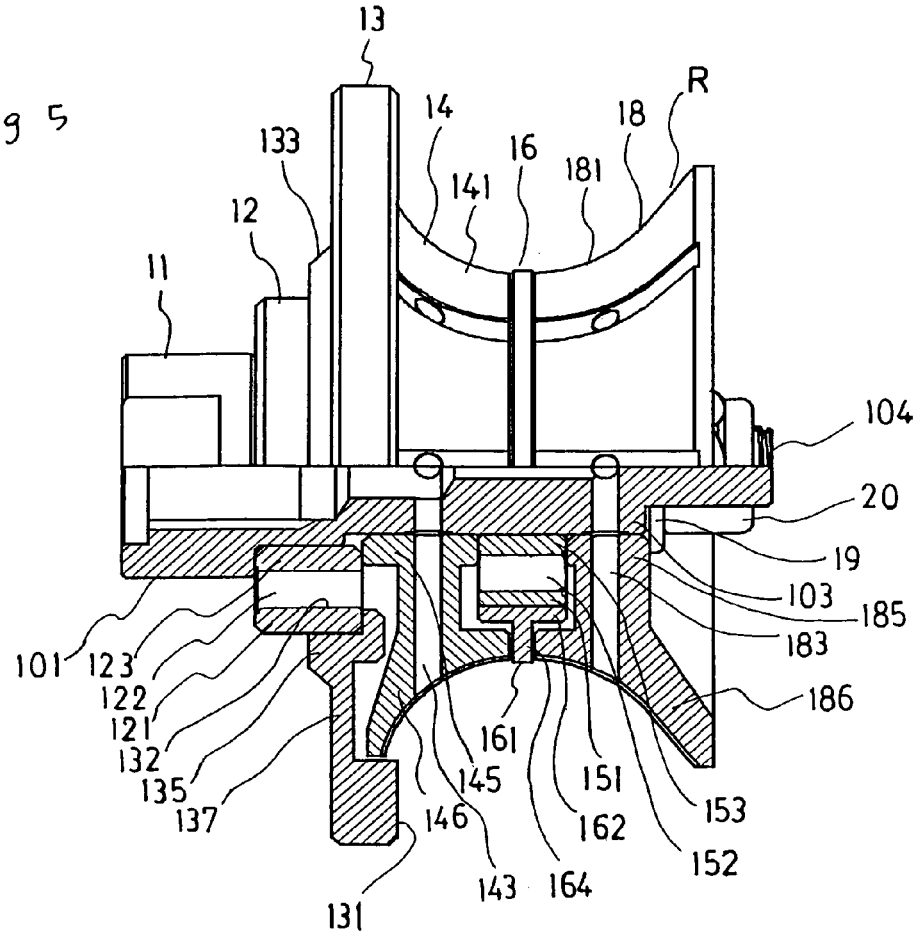
FIG. 5 is a side view whose part is indicated with a section of the grinding tool for edge circular processing of this embodiment.

The guide plate 13 constituted of a disk-like member in which a first bearing 12 is fitted to the inside diameter portion thereof is mounted to the first spindle main body 102 of the rotary electric or air tool freely rotatably. As shown in FIG. 5, the guide plate 13 has through holes formed in the inside diameter portion in two steps and is comprised of a fitting hole 132 for the large diameter portion of the through hole to be fitted to the first bearing 12, a ring-like thick portion 135 around the fitting hole 132, a ring-like thin portion 137 around that and a ring-like guide portion 131 which is located further outside and whose side face opposing the profile wheel 18 is flat. By providing the thick portion 135 around the fitting hole 132 of the inside diameter portion, the guide plate 13 secures a wider contact area with respect to the first bearing 12 to be fitted and the strength of the guide plate 13 main body is intensified. On the other hand, by providing the ring-like thin portion 137 in the center portion adjacent thereto, the weight of the guide plate 13 main body is reduced. The first bearing 12 to be fitted to the bearing fitting hole 132 which is a through hole in the guide plate 13 is not limited to any particular one but an ordinary marketed bearing in which a plurality of steel balls 122 are loaded between an external wheel 121 and an internal wheel 123 can be selected appropriately for use. The internal wheel 123 of the first bearing 12 is fixed between the proximal portion 101 of the spindle 11 and the thick portion 145 of the first profile wheel 14 by tightening the lock nut 20 and because the external wheel 121 of the first bearing 12 is fitted to the bearing fitting hole 132 in the first guide plate 13, the first guide plate 13 makes free of a rotation of the spindle 11 of the rotary electric tool, thereby securing a free rotation thereof.

Figure 7:
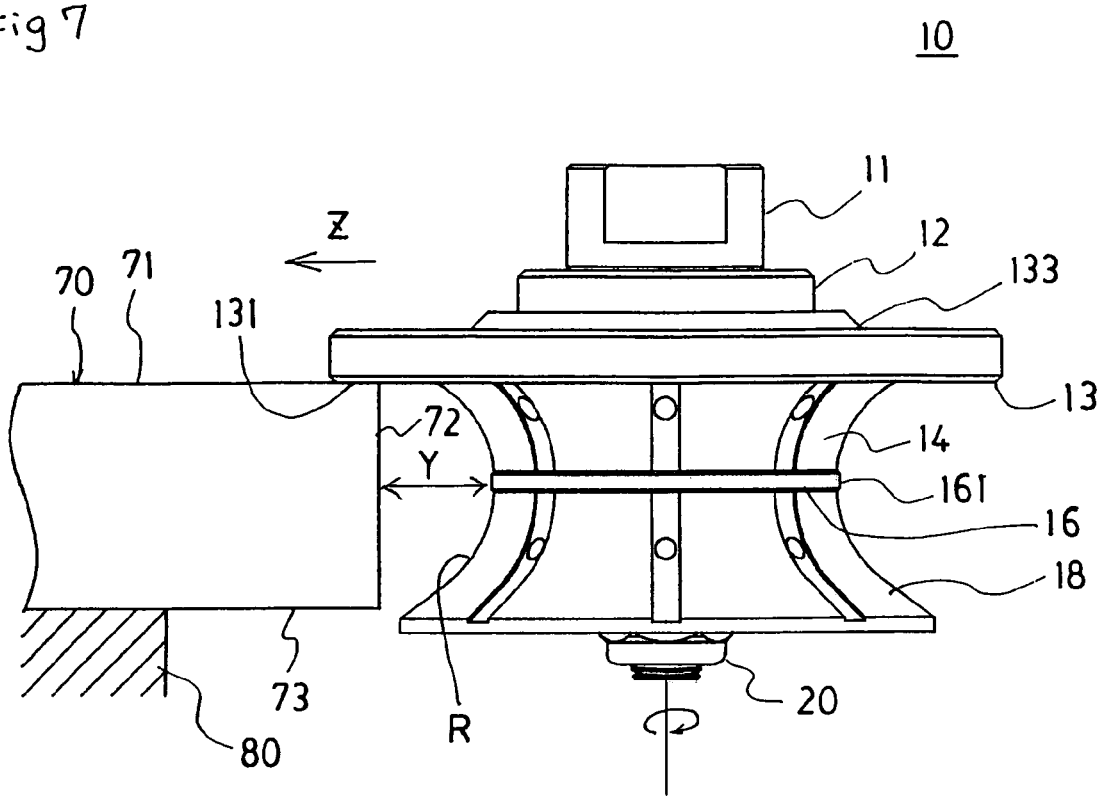
FIG. 7 is a diagram showing a state just before grinding processing with the grinding tool for edge circular processing of this embodiment.
Figure 8:
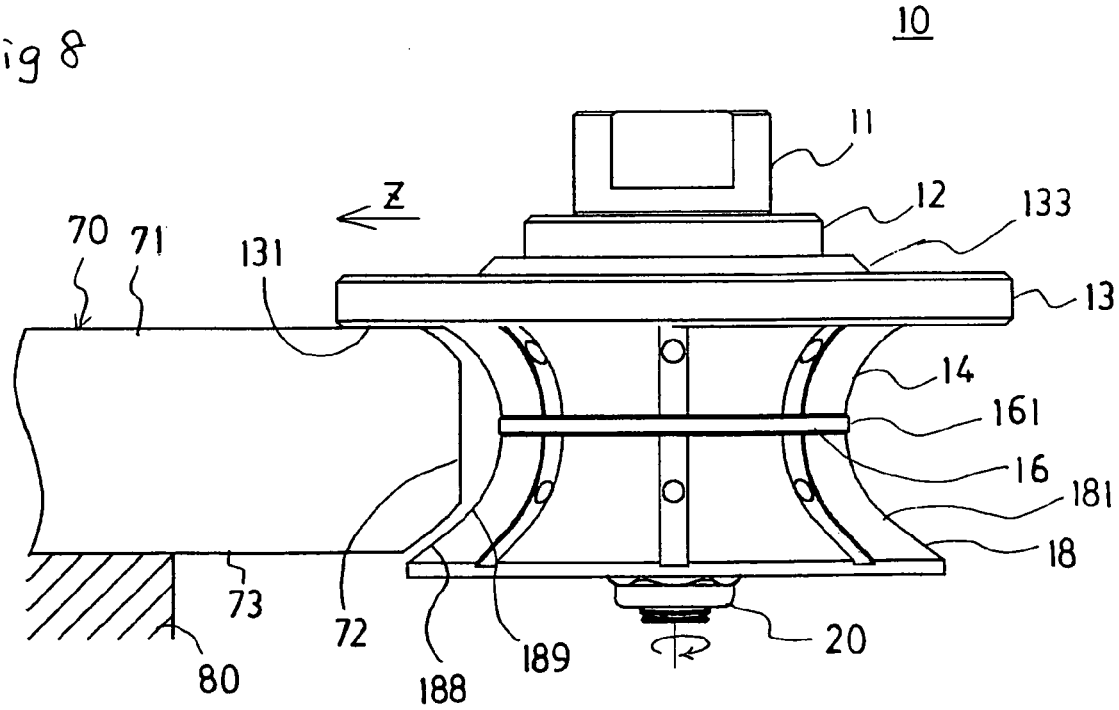
FIG. 8 is a diagram showing a state on the way of grinding processing with the grinding tool for edge circular processing of this embodiment.
Figure 9:
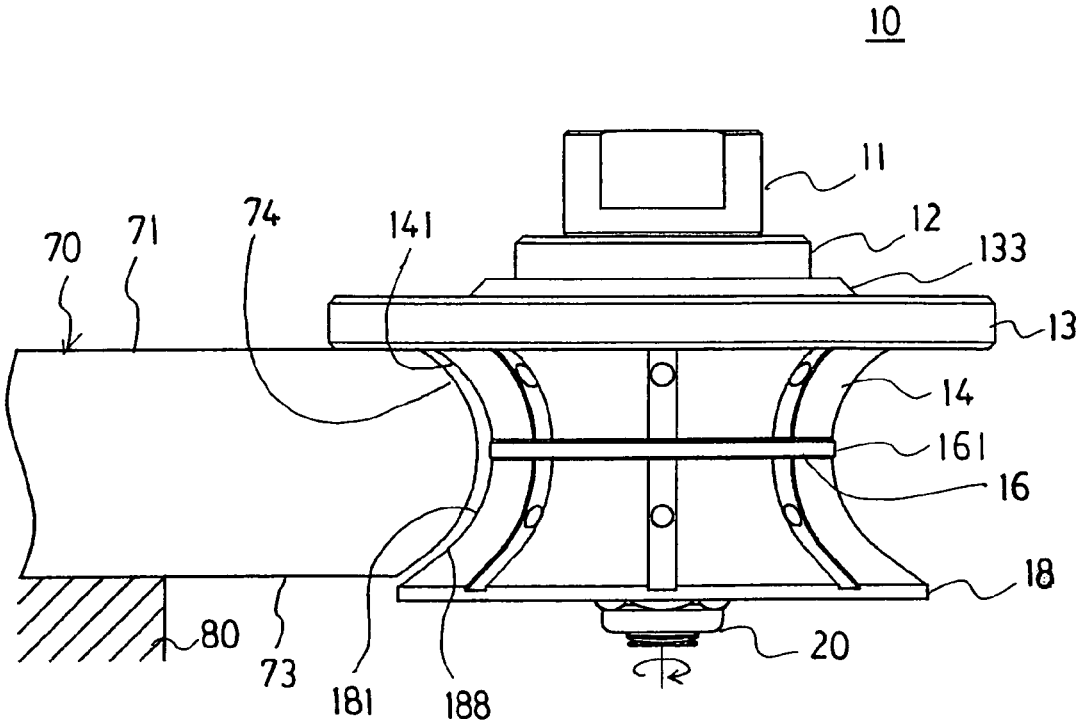
FIG. 9 is a diagram showing a state when the grinding processing with the grinding tool for edge circular processing of this embodiment is completed.

As for the guide plate 13, when a grinding object material edge 72 is ground, as shown in FIGS. 7–9, the flat outer peripheral edge 131 of the guide plate 13 is brought into contact with the reference face of the grinding object material 70, that is, a surface 71 of the slab plate in this example, so that horizontality in the grinding direction is maintained so that the concave shape having a predetermined curvature is controlled easily and at the same time, vibration provided by the electric tool which rotates at high speeds is absorbed, thereby contributing largely to prevention of deflection. In the meantime, although the guide plate 13 needs to have a larger diameter than the maximum diameter of the grinding surfaces 141, 181 of the profile wheels 14, 18 and a specified strength, it is preferred to be formed selectively of relatively light weight metal, resin or composite material thereof considering the weight of the entire tool. More specifically, as the metal, for example, light metal such as magnesium and aluminum or alloy thereof is of relatively light weight and has a specified heat resistance and stiffness and an excellent processability, which is preferable. If components for constituting the guide plate 13 are made of various kinds of resins, more preferably, the surface 71 of the slab plate composed of marble stone finished by grinding or the like is never damaged by them. Further, as the composite material, fiber reinforced metal, heat resistant fiber reinforced resin and the like can be mentioned. The thickness of thick portion of the guide plate 13 is not restricted to any particular value but it is designed considering the strength of the material, the weight of the entire tool and further, resonance accompanied by the rotation of the tool and usually, about 5–10 mm.

The stopper ring 15, which is fitted such that it is sandwiched between the first profile wheel 14 and the second profile wheel 18 and mounted freely rotatably, is comprised of a ring-like member 165 smaller than the guide plate 13 and a ring-like portion 162 which is located inside the ring-like member 165 and in which a fitting hole 163 is provided on an inside diameter portion formed integrally with the ring-like member 165. It is mounted on the second spindle main body 103 through the second bearing 15 fitted to the fitting hole 163, so that it is kept rotatable free of a rotation of the spindle 11.

The stopper ring 16 is a ring object which is located between the first profile wheel 14 and the second profile wheel 18 opposing each other and installed on the spindle 11 through the second bearing 15 fitted to its inside diameter portion in order to determine a grinding distance (grinding depth) Y from the edge (reference face) 72 of the grinding object material 70. Although the shape of the stopper ring 16 is preferred to be thin if speaking ideally because it is sandwiched between the two profile wheels 14 and 18 to determine the grinding distance Y so that there is not left any portion not ground on the edge (reference face) 72 of the grinding object material 70, it cannot be denied to incorporate the second bearing 15 in order to maintain a free condition to the rotation of the spindle 11 and control the grinding distance completely and it needs to secure a contact area with the second bearing 15 to be fitted with a specified width. Then, in this example, a ring-like portion 162 is provided in the inside diameter portion of the stopper ring 16, that is, around the fitting hole 163 of the second bearing 15 so as to secure a contact area with the second bearing 15 and an outer peripheral edge 161 acting as a guide portion is formed as thin as possible to meet such demands. The stopper ring 16 has a smaller diameter than the guide plates 13 and at the same time, its outside diameter is substantially equal to the minimum grinding faces of the two profile wheels 14, 18 or slightly larger and the thickness thereof is set smaller than the guide plate 13. Thus, it requires a specified strength from the above-described reasons and considering the weight of the entire tool, it is preferable to form it selectively of relatively light weight metal, resin or composition material thereof like the guide plate 13. When the grinding object material edge 72 is ground, the outer peripheral end face 161 of the stopper ring 16 approaches the edge 72 of the grinding object material 70, that is, the edge (reference face) 72 of the slab plate 70 in this example, with a progress of grinding and when that end face 161 makes contact with the edge 72, the progress of grinding is stopped so that the grinding distance (grinding depth) Y is controlled easily and securely. Although the second bearing 15 to be fitted to the bearing fitting hole 163 of the stopper ring 16 is smaller than the first bearing 12, it is substantially of the same type and as this bearing, an ordinarily marketed bearing in which a plurality of steel balls 152 are loaded between the external wheel 151 and the internal wheel 153 may be selected appropriately for use.

In the grinding tool for edge circular processing of the present invention, to the spindle 11 of each of various hand-held electric or air tools (not shown) are mounted the disk-like guide plate 13 in which the first bearing 12 is fitted to the fitting hole 132 which is the inside diameter portion, the substantially semi-conical first profile wheel 14 whose edge has a concavely shaped grinding face 141, the ring-like stopper ring 16 in which the second bearing 15 is fitted to the fitting hole 163 which is the inside diameter portion and the substantially conical second profile wheel 18 whose edge is concavely shaped and which has the grinding face 181 asymmetrical with the first profile wheel 14 in this order such that they are perpendicular to the axis of the spindle 11. After that, the lock nut 20 is tightened to the spindle 11 located outside of them through a flat washer 19. That is, the guide plate 13 is mounted on the first spindle main body 102 through the first bearing 12, the first profile wheel 14 is mounted on the second spindle main body 103 such that its grinding face 141 is directed forward with the guide plate 13 located behind it, the stopper ring 16 is mounted through the second bearing 15 and further, the second profile wheel 18 is mounted such that its grinding face 181 is directed rearward with the lock nut 20 located behind it. In the grinding tool for edge circular processing 10, the grinding face 141 of the first profile wheel 14 and the grinding face 181 of the second profile wheel 18 are opposed to each other so as to form a concavely shaped grinding face R having a substantially semi-circular section while the grinding face R serves for an outer peripheral face.

Next, an example of grinding method of full bullnose processing of the edge 72 of a grinding object material using the grinding tool for edge circular processing 10 of this embodiment will be described. First, the grinding object material 70 whose surface 71 is set upward is fixed on a grinding jig 80 having a horizontal plane. With a switch of the electric or air tool turned ON in advance, the flat side face 131 of the guide plate 13 is brought into contact with the reference face (surface) 71 so as to determine a position relation between the grinding object material 70 and the rotary grinding tool (FIG. 7). With this condition, the grinding face R of the profile wheel opposes the edge (reference face) of the grinding object material at right angle so as to secure a predetermined curvature. Next, with the side face 131 of the guide plate 13 kept in parallel to the grinding direction (arrow Z in the same Figure), the grinding processing is executed. Because at this time, the guide plate 13 is static on the reference face 71 of the grinding object material 70 without being affected by the rotation of the spindle 11, the profile wheel can be maintained so that it is always constant to the grinding direction. Then, grinding is carried out from the corner portion of the edge 72 of the grinding object material (FIG. 8). Because the grinding face 181 of the second profile wheel is formed in a tapered inclined face 188 which is directed outward from the substantially middle portion 189 of the grinding face 181, it can grind smoothly without crushing the corner portion of the edge 72 of the grinding object material at the initial period of grinding and even if there exists more or less deviation in the thickness of the slab plate which is the grinding object material, it can accept this so as to correspond flexibly. Because the outer peripheral end face 161 of the stopper ring 16 makes contact with the edge 72 of the grinding object material in a progress of grinding from the edge 72 of the grinding object material to the center of the grinding object material, the progress of the profile wheel in the depth direction is stopped (FIG. 9). At this time, because the stopper ring 16 is static at the end of the edge 72 without being affected by the rotation of the spindle 11, deflection by the hand can be prevented. On the other hand, as for the grinding method for grinding at right angle to the depth direction and along the edge 72 (direct ion of an arrow X in FIG. 13), it is reciprocated over an appropriate distance after starting from an appropriate position and this procedure is repeated by moving further. According to the grinding method of this embodiment, an accurate and stable curvature can be obtained repeatedly on the edge 72 and a beautiful finish surface 74 having a semi-circular section is formed on the grinding object material. Particularly if the finish face 74 is observed from obliquely upward, the upper half portion of the semi-circular section can be turned to a uniformly round shape.

FIRST EMBODIMENT

Figure 3:
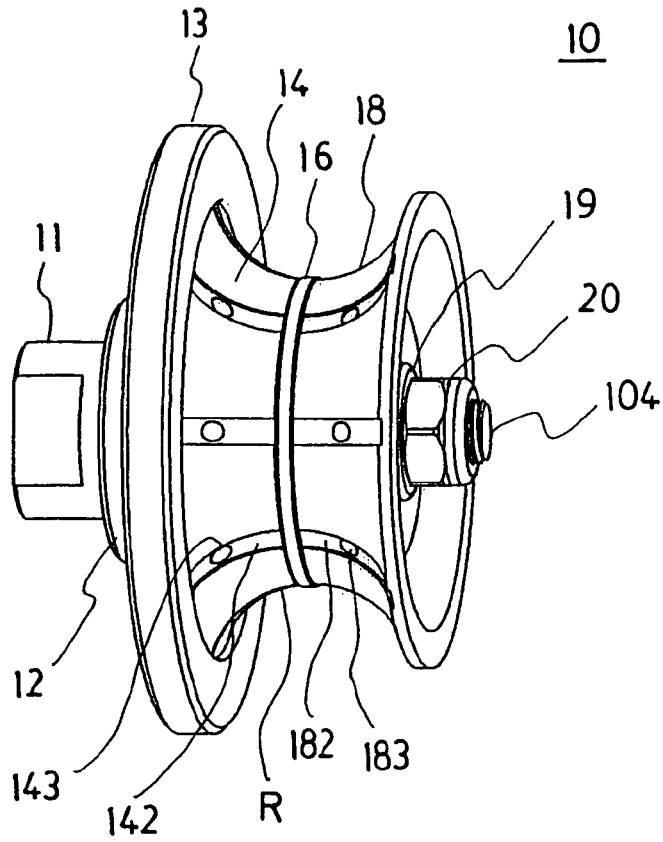
FIG. 3 is a perspective view of the grinding tool for edge circular processing of this embodiment as seen from its front end.
Figure 4:
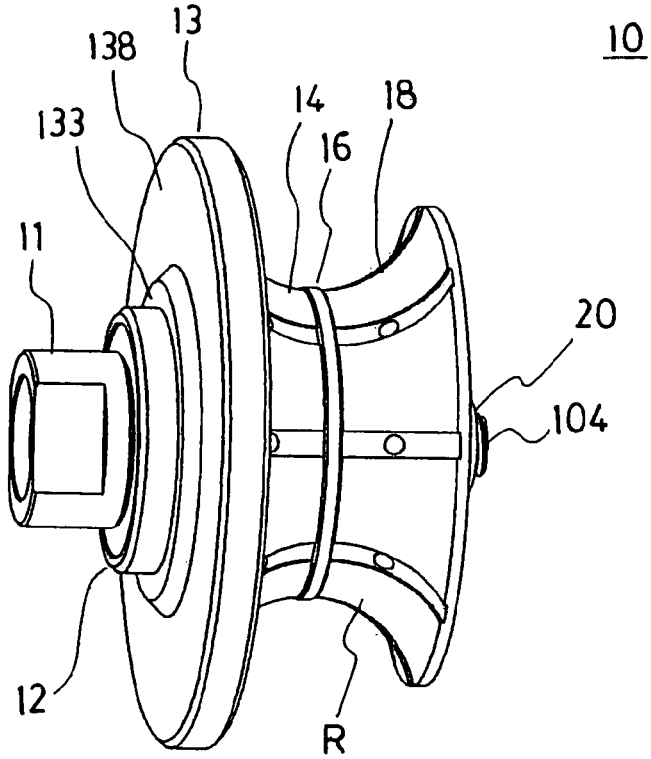
FIG. 4 is a perspective view of the grinding tool for edge circular processing of this embodiment as seen from an electric tool.

A marketed hand-held polisher was prepared and respective components formed as shown in FIGS. 1–5 were fitted in and fixed on multiple-stage spindle 11 of the polisher so as to constitute an edge constant angle grinding tool 10. More specifically, to the first spindle main body 102 having an outside diameter of 20.0 mm were fitted the guide plate 13 made of resin having an outside diameter of 96.2 mm and thickness of 7.5 mm in which the first bearing 12 was fitted to the bearing fitting hole 132 and to the spindle main body 103 was fitted the first profile wheel 14 based on the specification described later such that its grinding face 141 was directed forward. Next, the stopper ring 16 was fitted through the second bearing 15 and further the second profile wheel 18 based on the specification described later was fitted to the spindle main body 103 located outside beyond the stopper ring 16 such that its grinding face 181 was directed to the first profile wheel 14. By tightening the lock nut 20 fastened to the male screw portion 104 through the flat washer 19, it was fixed in a perpendicular condition to the axis of the spindle 11. At this time, the internal wheel 123 of the first bearing 2 fitted to the first spindle main body 102 made contact with the proximal portion 101 of the spindle 11 and according to the order described below, the first profile wheel 14, the internal wheel 153 of the second bearing 15, the second profile wheel 18 and the flat washer 19 were fitted to the second spindle main body 103 such that they kept contact with each other and by tightening the lock nut 20 fastened to the male screw portion 104, fixed firmly, thereby finally completing the grinding tool for edge circular processing of this example in which a predetermined concavely shaped grinding face was formed. Abrasive brazing portions 144, 184 composed of diamond abrasive brazing layer were formed on the grinding faces 141, 181 of the first profile wheel 14 and the second profile wheel 18 and as shown in FIGS. 3, 4, six cutout grooves 142, 182, 0.5 mm deep were formed in the abrasive brazing portions 144, 184 so that they were located at an equal angle along the circumference and extended in the axial direction. A through hole 143, 183, which went through toward the axis, was formed in each of the cutout grooves 142, 182.

First profile wheel; the grinding face shape thereof is shown on the left side of FIG. 6 while the radius $R_1$ of the concavely shaped grinding face 141 is 17.5 mm, the minimum diameter of the grinding face is 48.5 mm, the maximum diameter of the grinding face is 72.5 mm and the height (thickness in the axial direction) is 16.6 mm.

Second profile wheel; the grinding face shape thereof is shown on the right side of FIG. 6 while the radius $R_1$ of the concavely shaped grinding face 181 from the small diameter portion 187 of the grinding face 181 to the substantially middle portion 189 is 17.5 mm, the minimum diameter of the grinding face is 48.5 mm, the maximum diameter of the grinding face is 75.5 mm, the height (thickness in the axial direction) is 20.0 mm and a substantially straight inclined face (tapered face) 188 is formed from the middle portion 189 of the grinding face 181 in the direction to the outer periphery.

Figure 10:
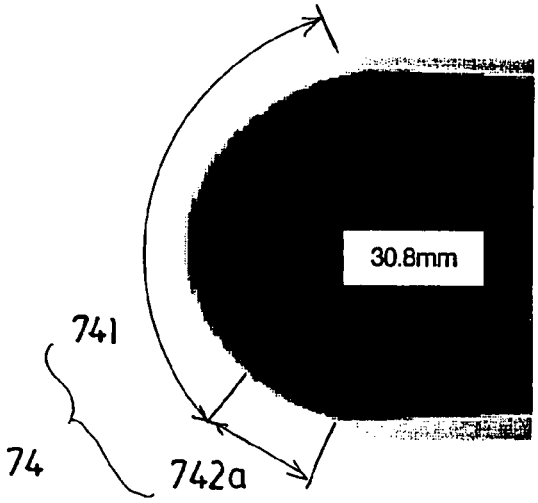
FIG. 10 is a photograph of the edge of the grinding object material processed according to the first embodiment.
Figure 13:
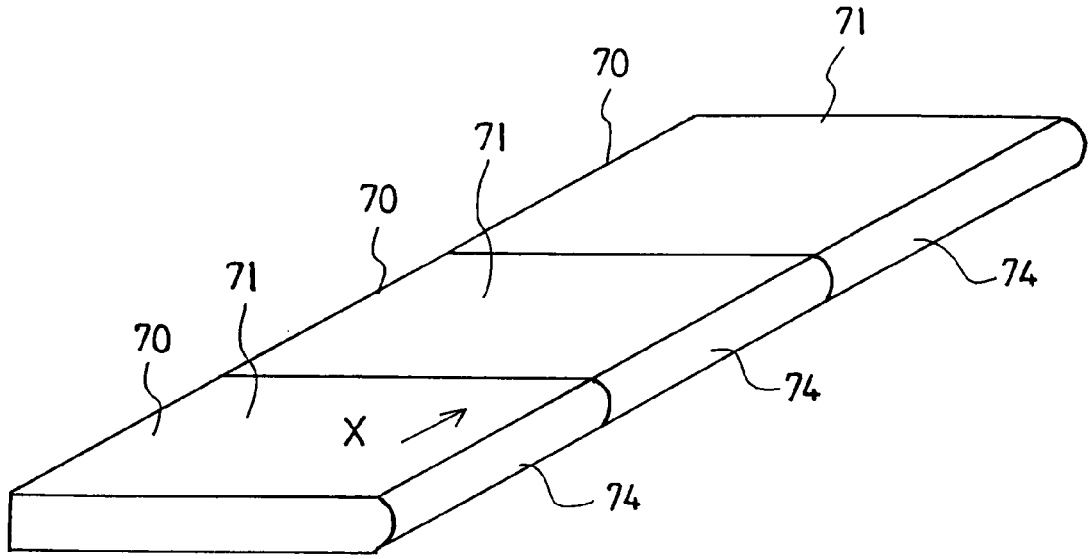
FIG. 13 is a plan view showing a horizontal arrangement of three grinding object materials processed according to the first embodiment.

Three pieces of granite slab plates 30.8 mm thick and 1000 mm square were prepared as the grinding object material 70 and with the surface 71 of the grinding object material and the edge 72 continuous therefrom set as the reference surface, the edge circular processing in the shape of a circular section 15 mm in radius was carried out to the edge 72 of the grinding object material 70 using the aforementioned grinding tool for edge circular processing (hereinafter referred to as "grinding tool"). With the guide face 131 of the guide plate 13 of the grinding tool in a horizontal contact with the surface 71 of the grinding object material 9 fixed on the flat grinding jig 10 as shown in FIG. 10, with the electric tool ON, grinding of the edge 72 was started. The guide plate 13 maintained the horizontality of the grinding object material 70 with respect to the reference face in a stabilized condition regardless of the electric tool rotating at high speeds due to the operation of the fitted first bearing 12 and the grinding made progress extremely smoothly. Then, after a process shown in FIG. 8, finally, the outer peripheral end face 161 of the stopper ring 16 reached the reference face of the edge 72 of the grinding object material 70 as shown in FIG. 9 and when it made contact, the progress of the grinding was stopped and as a result, a grinding distance Y from the edge (reference face) 72 of the grinding object material 70 was determined. As for the edge of the grinding object material 70 processed in this way, a uniform finish surface 74 having a semi-circular roundness was formed as shown in FIG. 10 and if the finish surface was observed from obliquely upward, the upper half portion of the semi-circular section, that is, upper ¼ circular section 741 had roundness while lower ¼ portion was of flat oblique face. Further, the full bullnose processing was carried out on other two pieces of the grinding object materials 70 according to the same method. Consequently, a uniform finish surface having the same semi-circular section as photograph of FIG. 10 was formed on the edge of the grinding object material 70 and the upper half portion of the semi-circular section, that is, upper ¼ circular section portion 741 had roundness while lower ¼ portion was of flat oblique face. When these three processed grinding object materials 70 were joined together in parallel, as shown in FIG. 13, the edges having the semi-circular section shape could be made continuous precisely with a specified shape and distances from the edge of the semi-circular section shape to an edge on an opposite side were set up accurately. It was confirmed that the grinding distance Y from the edge (reference face) 72 as well as the predetermined curvature were controlled at a good precision.

SECOND EMBODIMENT

Figure 11:
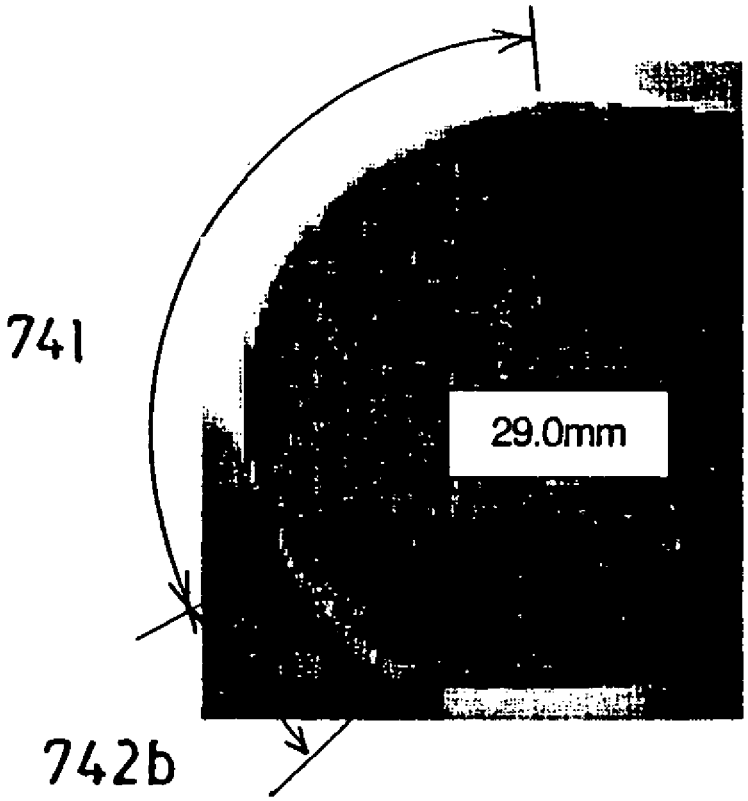
FIG. 11 is a photograph of the edge of the grinding object material processed according to the second embodiment.

The full bullnose processing was carried out to three pieces of grinding object materials in the same way as the first embodiment except that the thickness of the grinding object material was set to 32.5 mm instead of 30.8 mm. As shown in photography of FIG. 11, a uniform finish surface approximate to semi-circle was formed in any grinding object material and if the finish surface was observed from obliquely upward, the upper half portion of the semi-circular section, that is, upper ¼ circular section shape was ground into the same shape and it was confirmed that the grinding distance Y as well as the predetermined curvature were controlled precisely.

THIRD EMBODIMENT

Figure 12:
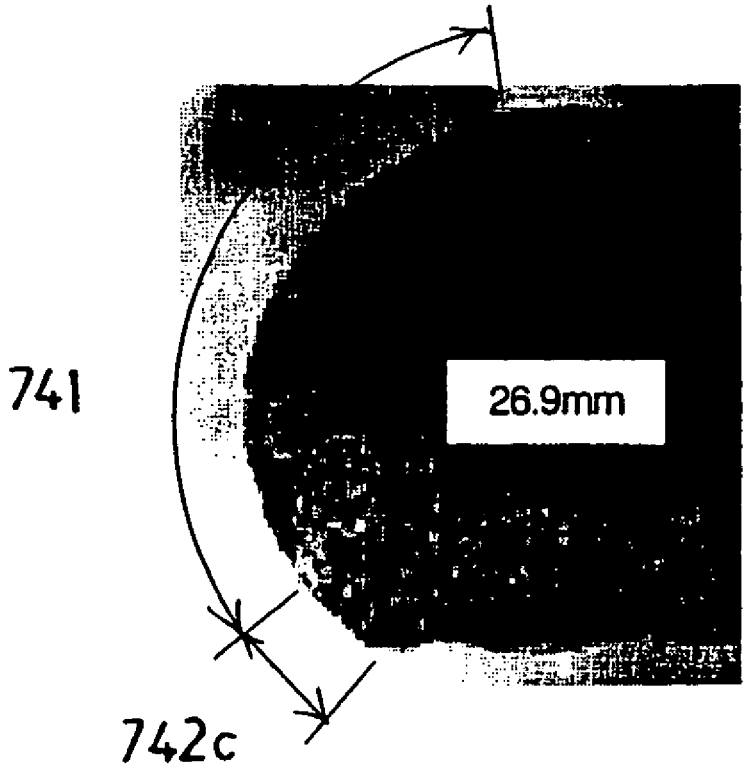
FIG. 12 is a photograph of the edge of the grinding object material processed according to the third embodiment.

The full bullnose processing was carried out on three pieces of grinding object materials in the same way as the first embodiment, except that the thickness of the grinding object material was set to 28.2 mm instead of 30.8 mm. As shown in photography of FIG. 12, a uniform finish surface approximate to semi-circular section shape was formed in any grinding object material and if the finish surface was observed from obliquely upward, the upper half portion of the semi-circular section, that is, upper ¼ circular section shape was ground into the same shape and it was confirmed that the grinding distance Y as well as the predetermined curvature were controlled precisely.

As a result of arranging grinding object materials which underwent the edge circular processing according to the first-third embodiments in line and observing their end faces from obliquely upward, it was confirmed that the semi-circular upper half portion of the processed edge, that is, the upper ¼ portion having the circular section were ground into the same configuration and processed into a shape having a neat configuration in appearance viewpoints.

INDUSTRIAL APPLICABILITY

The grinding tool for edge circular processing of the present invention has been verified to function extremely effectively in the so-called full bullnose processing of forming a semi-circular edge in a slab plate of natural marble or the like, because it ground accurately at an excellent balance with a predetermined curvature and grinding distance Y, despite such a simple structure in which grinding surfaces opposing each other at right angle of a pair of the profile wheels are formed asymmetrically with a guide plate and a stopper ring. Further, it requires no skilled engineer having any particular high level skill in grinding work on a site and this edge circular processing can be implemented relatively easily, stably and effectively by a worker trained in a specific course. Further because the grinding tool for edge circular processing of the present invention allows working with the guide plate placed on the reference face of a grinding object material, even an unskilled worker can handle an electric or air tool rotating at high or low speeds easily and continue the work with safety. Further, because the aforementioned predetermined curvature of the present invention enables the radius R of the grinding surface of a profile wheel for use to be changed appropriately, it is expected that this tool is applied to a wide field.

The invention claimed is:

1. A grinding tool comprising:

a profile wheel including a semi-conical first profile wheel having an edge with a substantially concave grinding surface and a semi-conical second profile wheel having an edge with a substantially concave grinding surface asymmetrical to said first profile wheel, the first and second profile wheels are fixed to a spindle of a rotary electric or air tool such that the grinding surfaces are opposed to each other so as to form a substantially semi-circular concave grinding surface that is an outer peripheral face;

a guide plate having an edge, rotatably mounted on the spindle, the edge of the disk guide plate is configured to contact a reference face of a grinding object material surface to guide the grinding object in a grinding direction, the guide plate has an outer diameter larger than the maximum outer diameter of said profile wheel; and a stopper ring rotatably mounted on the spindle between said first profile wheel and said second profile wheel configured to control a grinding distance Y from the edge by bringing an outer peripheral end face thereof into a contact with the edge of said grinding object material, wherein said profile wheel, said guide plate and said stopper ring are fixed with a lock not to the spindle of said rotary electric or air tool.

2. The grinding tool according to claim 1 wherein said guide plate is substantially in the shape of a disk and has a bearing fitting hole in the center thereof, and the guide plate is configured to be mounted on the spindle via a first bearing configured to be fitted into the bearing fitting hole.

3. The grinding tool according to claim 1 wherein said stopper ring is substantially in the shape of a ring and has a bearing fitting hole in the center thereof, the stopper ring has an outside diameter substantially equal to or slightly larger than the minimum diameter of the grinding surface of said pair of the profile wheels, and the stopper ring is configured to be mounted on the spindle via a second bearing configured to be fitted into the bearing fitting hole.

4. The grinding tool according to claim 1 wherein said first profile wheel is mounted on an electric or air tool side such that the grinding surface is directed toward the stopper ring with said guide plate located at an opposite side of said first profile wheel than the stopper ring and said second profile wheel is mounted such that the grinding surface is directed toward the stopper ring and first profile wheel with a lock nut located at an opposite side of said second profile wheel than the grinding surface.

5. The grinding tool according to claim 4 wherein the substantially concave grinding surface of said second profile wheel includes a first end portion, a second end portion and a substantially middle portion, the second end portion is provided with a substantially tapered inclined face which extends to the outer periphery of the second end portion from the substantially middle portion.

6. The grinding tool according to claim 1 wherein a plurality of cutout portions are formed in the grinding surface of said profile wheel at an equal pitch along the circumference such that the cutout portions are extended in the axial direction.

7. The grinding tool according to claim 1, further comprising at least one through holes configured to supply water to the grinding surface, at least one through hole is located in said cutout portion formed in the grinding surface of said profile wheel.

8. The grinding tool according to claim 1 wherein said guide plate and stopper ring are manufactured of metal, resin or composite material thereof.

9. The grinding tool according to claim 1 wherein said grinding object material is a plate composed of natural stone, engineered stone or the like.

10. The grinding tool according to claim 1 wherein the edge of the grinding object material after edge circular processing with said grinding tool, is formed into a round shape having a substantially semi-circular section while an upper ¼ circular portion of the semi-circular section shape is always ground into a same shape regardless of a thickness of the grinding object material.

* * * * *

UNITED STATES PATENT AND TRADEMARK OFFICE

CERTIFICATE OF CORRECTION

PATENT NO. : 7,094,136 B2
APPLICATION NO. : 11/148210
DATED : August 22, 2006
INVENTOR(S) : Nomoto et al.

It is certified that error appears in the above-identified patent and that said Letters Patent is hereby corrected as shown below:

On the title page, Item (73), the Assignee information is incorrect. Item (73) should read:

-- (73) Assignees: Sankyo Diamond Industrial Co., Ltd.,
Ebina (JP); Nao Enterprise Inc.,
Wyckoff, NJ (US) --

Signed and Sealed this

Fourteenth Day of November, 2006

JON W. DUDAS
*Director of the United States Patent and Trademark Office*